US010837246B2

(12) United States Patent
Tubel

(10) Patent No.: US 10,837,246 B2
(45) Date of Patent: Nov. 17, 2020

(54) SYSTEM FOR ACQUISITION OF WELLBORE PARAMETERS AND SHORT DISTANCE DATA TRANSFER

(71) Applicant: Tubel Energy LLC, The Woodlands, TX (US)

(72) Inventor: Paulo Tubel, The Woodlands, TX (US)

(73) Assignee: Tubel LLC, The Woodlands, TX (US)

( * ) Notice: Subject to any disclaimer, the term of this patent is extended or adjusted under 35 U.S.C. 154(b) by 0 days.

(21) Appl. No.: 16/526,773

(22) Filed: Jul. 30, 2019

(65) Prior Publication Data

US 2019/0352989 A1 Nov. 21, 2019

Related U.S. Application Data

(63) Continuation-in-part of application No. 16/429,722, filed on Jun. 3, 2019, and a continuation of application No. 14/728,587, filed on Jun. 2, 2015, now Pat. No. 10,408,004.

(51) Int. Cl.

| | |
|---|---|
| ***E21B 23/02*** | (2006.01) |
| ***E21B 47/01*** | (2012.01) |
| ***E21B 41/00*** | (2006.01) |

(52) U.S. Cl.

CPC ..... *E21B 23/02* (2013.01); *E21B 41/0085* (2013.01); *E21B 47/011* (2013.01)

(58) Field of Classification Search

CPC ..... E21B 23/02; E21B 41/0085; E21B 47/011
USPC ..... 340/854.6
See application file for complete search history.

(56) References Cited

U.S. PATENT DOCUMENTS

| | | | | |
|---|---|---|---|---|
| 8,284,075 | B2 * | 10/2012 | Fincher | E21B 17/028 290/1 R |
| 2011/0169656 | A1 * | 7/2011 | Khan | G01V 11/002 340/854.6 |
| 2012/0235677 | A1 * | 9/2012 | Blanz | G01N 24/081 324/303 |
| 2013/0154650 | A1 * | 6/2013 | Bittar | E21B 47/02216 324/336 |
| 2013/0241742 | A1 * | 9/2013 | Contant | G01V 3/30 340/854.6 |
| 2015/0107824 | A1 * | 4/2015 | Signorelli | E21B 41/0085 166/244.1 |
| 2016/0010447 | A1 * | 1/2016 | Merino | E21B 47/122 340/854.6 |
| 2016/0084982 | A1 * | 3/2016 | Donderici | G01V 3/18 340/854.6 |

(Continued)

*Primary Examiner* — Hirdepal Singh
(74) *Attorney, Agent, or Firm* — Maze IP Law, P.C.

(57) ABSTRACT

This system invention relates to the use of short hop communications to transfer data between two modules inside a well. A system deployed in a well permanently or semi-permanently collects data from downhole parameters such as pressure, temperature, vibration, flow and fluid identification and stores the information in the system memory. The receiver module is deployed in the well via slick line, electric line or coil tubing with the purpose of retrieving the data from the system memory by interfacing with the downhole module via wireless short hop communications. The receiver module can also send commands into the downhole module to change its data collection parameters. Upon completion of the data transfer, the collector is returned to the surface where the data is again wirelessly transferred to a processing system such as a Personal Computer.

19 Claims, 3 Drawing Sheets

(56) References Cited

U.S. PATENT DOCUMENTS

2019/0153857 A1* 5/2019 Yi ..... E21B 47/011
2019/0292902 A1* 9/2019 Jarvis ..... G01K 1/026

* cited by examiner

SYSTEM FOR ACQUISITION OF WELLBORE PARAMETERS AND SHORT DISTANCE DATA TRANSFER

RELATIONSHIP TO OTHER APPLICATIONS

This application is a continuation-in-party of of U.S. patent application Ser. No. 16/429,722 filed 3 Jun. 2019 which is a continuation of U.S. patent application Ser. No. 14/728,587 filed 2 Jun. 2015.

BACKGROUND OF THE INVENTION

Data acquisition in well during production and drilling have occurred for many years. In the production sector of the exploration and production of hydrocarbons, the use of downhole gauges for production and reservoir evaluation are done using permanent and retrievable systems.

The retrievable systems are normally deployed inside production tubing using an electrical cable that transmits information from the well in real time to the surface as the system is pulled from the bottom of the sell to the surface, logging the entire well for data.

There are also permanently deployed gauges and semi permanent gauges. The permanent gauges use a cable mounted on the outside of the production tubing from the surface to where the gauge is located in the well. The gauges transmit data in real time continuously. If the cable is cut then the gauge is no longer connected to the surface and no data is transferred to the surface. The cable deployment is also very complicated and can cause the customer to have to go in the well to fish the system if the cable is not flush to the production tubing.

There are semi-permanent gauges where the system seats in a side pocket mandrel inside the well. The gauge collects data and stores the data in memory. When the operator wants data he retrieves the gauge from the well. The customer uses specialty equipment to retrieve and install the gauge. There is a potential for the gauge to fall from the retrieval equipment and go to the bottom of the well. Also the gauge may not come out of the side pocket gauge.

A new system where the gauge does not to need to be retrieved from downhole and does not use downhole cables has been developed to decrease potential failures due to cut cables and complications in retrieving gauges from downhole.

SUMMARY

A first aspect of an embodiment the system disclosed comprises a downhole module deployed in a wellbore. The downhole module comprises a protective housing adapted to well conditions, a power source, at least one sensor to collect desired data downhole such as borehole and production parameters, downhole electronics for communication, storing and transmitting data, and an antenna or other means to facilitate the wireless transfer of data.

A second aspect of an embodiment of the system disclosed comprises a receiver module capable of being deployed in the wellbore, and adapted to communicate with the downhole module wirelessly. The receiver module comprises a receiver housing also adapted to well conditions, a receiver power source, and receiver electronics. The receiver electronics facilitates communication, and storing and transmitting data wirelessly between the downhole module and the receiver module utilizing a receiver transceiver, and a receiver data storage medium adapted to store and transmit data. The receiver module further comprises a receiver antenna or other means to facilitate wireless data transfer between the receiver and downhole modules. In such an embodiment, the receiver antenna and the downhole module antenna would be operatively in communication with their respective transceivers to accomplish the wireless transfer of data. The receiver module could be deployed in the wellbore through casing or through tubing.

In one embodiment of the system, multiple downhole modules can be deployed downhole with the capability of communicating data between downhole modules via short distance wireless data transfer, as well as between downhole modules and the receiver module. Downhole modules could be arranged in such a manner as to provide real time data through the wireless transfer of data along a string of downhole modules. In such an embodiment, data could be collected at the surface from the downhole module via a cable or receiver module. Downhole modules can be deployed as part of the tubing string, casing string or through tubing in a wellbore. The communications can be between a module in the casing to the module in the tubing, multiple modules in the casing or tubing and between modules in the casing or tubing and a through tubing module deployed in the well via electric line, coil tubing, slick line or pipe conveyed.

In another embodiment of the system, the downhole sensor or sensors comprise at least one of a pressure or temperature sensor for measuring borehole or production parameters.

In a further embodiment of the system, the downhole and receiver modules power sources could comprise batteries, other means of generating power such as through the use of magnetic, acoustic, or vibrational energy, any other means of harvesting energy downhole, or by an energetic cable. In another embodiment, the downhole module could be recharged or otherwise powered by means of wireless power transfer from the receiver module. Such means of transferring power from the receiver module to the downhole module could include magnetically generated energy, acoustic energy, or any other form of wireless energy.

In a further embodiment of the system, a latch assembly is used to facilitate positioning the receiver module near the downhole module. In such an embodiment, the latch assembly comprises latch housing, and a spring loaded assembly embedded within the housing with at least one angular protrusion intended to cause resistance when encountering a groove within the downhole module housing. The latch assembly in such an embodiment would further comprise a connection to the receiver module.

In a further embodiment of the system, modules can communicate using electromagnetic waves, acoustic, compressional, or shear waves, pressure pulses, or other means of communications between the modules.

While preferred aspects and embodiments of the system are shown and described herein, it will be understood that the invention may be embodied otherwise than herein specifically illustrated or described, and that certain changes in form and arrangement of parts and the specific manner of practicing the system may be made within the underlying idea or principles of the system.

BRIEF DESCRIPTION OF THE DRAWINGS

These and other features, aspects, and advantages of the system will become better understood with regard to the follow description, appended claims, and accompanying drawings where:

The various drawings supplied herein are representative of one or more embodiments of the present invention.

DESCRIPTION OF EMBODIMENTS

In the Summary above and in the Description of Embodiments, and the claims below, and in the accompanying drawings, reference is made to particular features of the system. It is to be understood that the disclosure of the system in this specification includes all possible combinations of such particular features. For example, where a particular feature is disclosed in the context of a particular aspect or embodiment of the system, or a particular claim, that feature can also be used, to the extent possible, in combination with and/or in the context of other particular aspects and embodiments of the system, and in the system generally.

Figure 1:
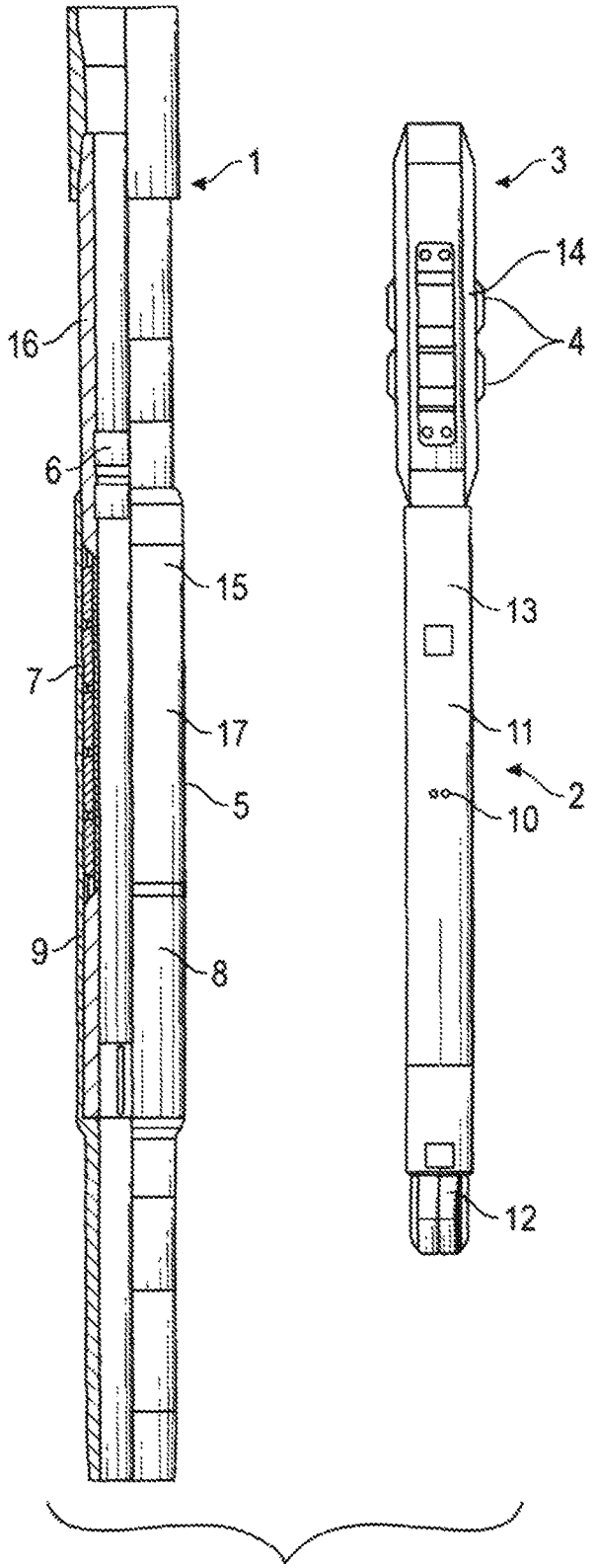
FIG. 1 shows a partial cutaway of an exemplary embodiment of a downhole module and an exemplary embodiment of a receiver module.

Referring now to FIG. 1, exemplary embodiments of a downhole module 1 and a receiver module 2 of an embodiment of the system are shown. FIG. 1 shows a partial cutaway of downhole module 1, displaying the interior of the downhole module 16, as well as the exterior of the downhole module 17. The downhole module 1 of the system is designed to be deployed downhole utilizing a housing 5. Housing 5 is designed to be deployed downhole along a casing string, tubing string, or through tubing, and provides protection and a framework for downhole module 1.

Referring additionally to FIG. 1, power source 7 utilizes batteries to power downhole module 1. In a preferred embodiment of the system, batteries utilized by power source 7 are rechargeable. In other embodiments of the system, power source 7 could utilize electromagnetic, acoustic, magnetic, or vibrational energy to power downhole module 1. In an additional embodiment of the system, power source 7 powers downhole module 1 by harvesting any source of energy downhole. Any source of energy that can be converted into electrical energy could be utilized by power source 7 to provide power to downhole module 1.

Still referring to FIG. 1, sensor or sensors 8 are disposed at least partially within housing 5, and collect desired data, such as borehole or production parameters, utilizing at least one sensor. Such sensor or sensors could include pressure, fluid identification, or temperature sensors.

In a preferred embodiment, data collected downhole by at least one data acquisition sensor 8 is transmitted to downhole electronics 9 from the sensor or sensors 8, where the data is stored by the data storage medium of the downhole electronics 9 utilizing any desired digital data storage method. In a preferred embodiment, the data storage medium of downhole electronics 9 utilizes flash memory to store data. Downhole electronics 9 further comprises a transceiver to enable communication for purposes including transmitting to and receiving data from receiver module 2. Antenna 15 is at least partially embedded in downhole module 1, and facilitates such communication by providing the means for wireless communication. When the downhole module 1 sends data, the data is sent from downhole electronics 9 from the data storage medium, and through the transceiver, to the antenna 15 for broadcasting.

Further referring to FIG. 1, in a preferred embodiment, receiver module 2 comprises a receiver housing 11 adapted to be deployed downhole. Receiver housing 11 further provides protection and a framework for receiver module 2. Receiver power source 13 is within receiver housing 11 and, in a preferred embodiment, comprises batteries or an energetic cable.

Receiver module 2 further comprises receiver electronics 10 at least partially disposed within receiver housing 11. The receiver electronics 10, in preferred embodiments, facilitates and controls communications, and further comprises a receiver transceiver, and a receiver data storage medium that can store and transmit data. The receiver data storage medium could utilize any desired means for storing digital data, including flash memory. Receiver antenna assembly 12 enables wireless communications, facilitating short hop data transfer between the downhole module 1 and the receiver module 2, and is operatively in communication with the receiver transceiver.

Figure 2:
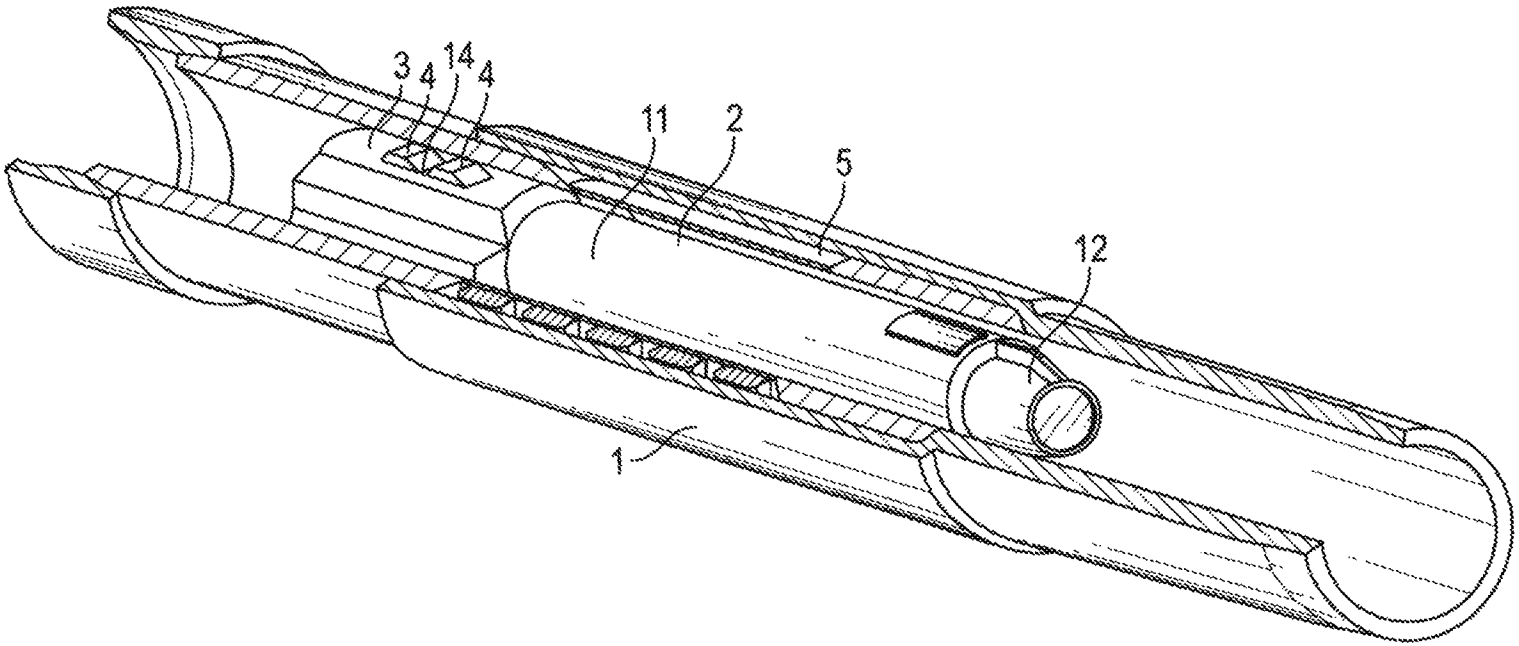
FIG. 2 shows a representative system wherein an exemplary receiver module is positioned to collect data from an exemplary downhole module deployed downhole.

When data is collected from the downhole module 1, receiver module 2 is deployed inside the casing or tubing, as exemplified in FIG. 2, to retrieve data from the downhole module. Referring now to both FIG. 1 and FIG. 2, in a preferred embodiment of the system, the receiver module 2 further comprises a latch assembly 3. The latch assembly 3 facilitates putting the receiver module 2 in a well such that the receiver module 2 is positioned at a desired distance from the downhole module 1 to enable wireless communication between the receiver module 2 and the downhole module 1.

In such an embodiment comprising latch assembly 3, the latch assembly 3 connects to the receiver module 2 via a connection, and comprises at least one angular protrusion 4, on it spring assisted assembly 14, which creates resistance when encountering the discriminating latch profile 6 of the downhole module. The discriminating latch profile 6, in a preferred embodiment, comprises at least one groove around the interior of the downhole module housing 5 which catches the angular protrusion 4, thereby creating resistance that can be detected by the operator. Such resistance indicates that the receiver module 2 is positioned as desired for wireless communication with the downhole module 1. The spring assisted assembly 14 allows the receiver module 2 to continue movement through the casing or tubing, or otherwise be removed from the well, by allowing the angular protrusion 4 to recede into the receiver housing 11 when encountering the discriminating latch profile 6, thereby creating resistance that can be detected by the operator, but still allowing the receiver module 2 to continue movement through the casing or tubing as desired.

In embodiments that do not include the latch module 3 and corresponding discriminating latch profile 6, the receiver module 2 is deployed on an electric line with a casing collar locator, thereby allowing an operator to determine the location of the receiver module 2 and position receiver module 2 within the well as desired for wireless communication with the downhole module 1.

Still referring to both FIG. 1 and FIG. 2, in a preferred embodiment of the system, when the receiver module 2 is positioned as desired relative to the downhole module 1, data is transferred from the downhole electronics 9 to the antenna 15, which wirelessly transmits desired data from the downhole module 1. The data transmitted from antenna 15 is then received by the receiver module 2 with the receiver antenna assembly 12, at which time the data is transmitted to the receiver electronics 10 through the receiver transceiver and then stored by the receiver data storage medium. Data can also be transmitted similarly from the receiver module 2 to the downhole module 1, as preferred embodiments of the system provide for two-way communication. Receiver module 2 can be retrieved from the well by the operator to provide acquired data to the surface.

In an embodiment of the system, multiple downhole modules 1 could be deployed along a casing or tubing string, creating a chain of downhole modules 1 such that the antenna 15 of one downhole module 1 could communicate data to another downhole module 1 where the data is received via another antenna 15. The data could then be transmitted along the chain of downhole modules 1, all the way to the surface if desired, thereby enabling real time communication of data. Data could be retrieved at the surface via the deployment of receiver module 2, or by a cable when the downhole module 1 further comprises a cable interface assembly.

In another embodiment of the system, the receiver module 2 could be used to provide power wirelessly to the downhole module 2 through the use of electromagnetic, magnetic, or other means of wireless power transfer. In an exemplary embodiment, power could be transferred from the receiver power source 13, or other source of power on the receiver module 2, to the power source 7 of downhole module 1 via the broadcast and corresponding receiving of electromagnetic energy which is then converted to electrical energy. In another exemplary embodiment, electrical energy could be created for the downhole module 1 through the disturbance of a magnetic field by the receiver module 2.

Figure 3:
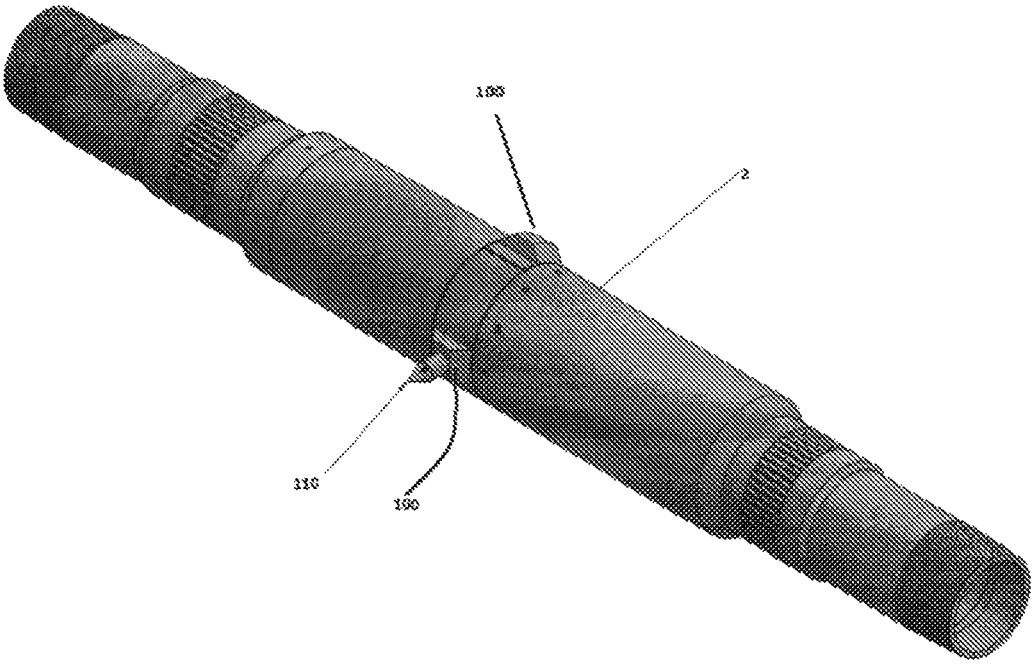
FIG. 3 is a view in partial perspective of an exemplary downhole module with standoffs and a probe.
Figure 4:
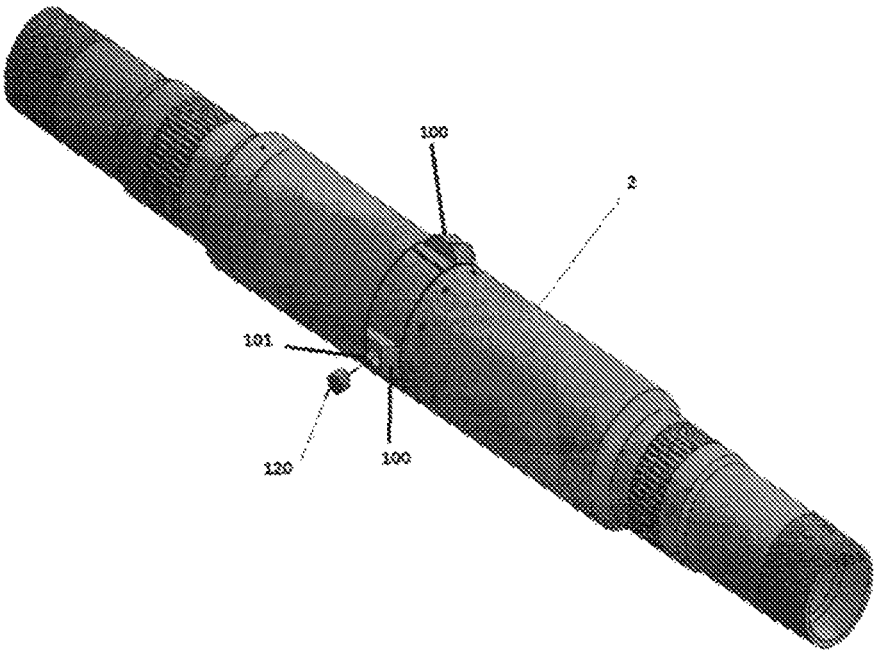
FIG. 4 is a view in partial perspective of an exemplary downhole module with standoffs and a dissolvable plug.

Referring now to FIGS. 3 and 4, in a further embodiment, a system for data acquisition and short distance wireless data transfer between wellbore modules comprises downhole module 1 which comprises protective downhole module housing 5 sized to be deployable and secured at a predetermined position within a wellbore such as in or part of a casing string, tubing string, or through tubing; downhole module power source 7 disposed within downhole module housing 5; one or more data acquisition sensors 8, which can be or otherwise comprise a gauge, operatively connected to downhole module power source 7; downhole electronics 9 which is as described above where downhole electronics 9 is operatively connected to power source 7, disposed within downhole module housing 5 and operatively in communication with data acquisition sensor 8; one or more standoffs 100 disposed about an outer portion of downhole module housing 5 and configured to extend from the outer portion of downhole module 1 to a distance proximate the wellbore into which the downhole module is disposed; and one or more data acquisition sensor ports 101, each data acquisition sensor port 101 extending through an associated standoff 100 and operatively in communication with at least one associate data acquisition data acquisition sensor 8. In addition, separate receiver module 2 is as described above.

However, as opposed to the embodiments described above, data acquisition sensor 8 may be disposed outside housing 5 such as to allow determination of cement or wellbore pressure. Further, as described herein, one or more data acquisition sensor ports 101, which may comprise pressure ports, allow obtaining information from the reservoir as it is frac'ed and when fluids are produced from the geological formation.

Typically, standoff 100 extends from housing 5 to a distance which places standoff 100 into contact with the wellbore into which the downhole module is disposed. In embodiments, standoff 100 may be a selectively movable standoff 100 and be operatively connected to selectively engageable standoff mover 102 (not shown in the figures) where selectively engageable standoff mover 102 comprises a piston, a spring, a hydraulic actuator, or the like, or a combination thereof. In these embodiments, standoff 100 may be in a first, retracted position in data acquisition sensor port 101 and extended using selectively engageable standoff mover 102 once downhole module 1 is at its desired location within the wellbore.

As noted, standoff 100 may comprise a set of standoffs 100 which may further be arranged about an outer portion of protective downhole module housing 5, e.g. circumferentially. In certain embodiments, standoff 100 may further extends or retract radially with respect to protective downhole module housing 5 such as by using selectively engageable standoff mover 102.

Typically, data acquisition sensor 8 in this embodiment is adapted to measure a borehole or production parameter and standoff 100 is configured to extend to a distance which allows data acquisition sensor 8 to obtain information, such as data regarding a reservoir into which the wellbore extends. Data acquisition sensor 8 may comprises a pressure data acquisition sensor, a fluid identification data acquisition sensor, a fluid characteristic data acquisition sensor, a fluid flow data acquisition sensor, a temperature data acquisition sensor, a movement sensor, or the like, or a combination thereof. As will be readily understood by one of ordinary skill in downhole frac or production art, "sensor" is used expansively herein and can be a gauge or the like.

In certain embodiment, dissolvable plug 120 may be present and inserted into a predetermined portion of data acquisition sensor port 101. This can be accomplished by any appropriate means such as, by way of example and not limitation, using a set of threads internal to data acquisition sensor port 101 and a complementary set of external threads on an outer portion of dissolvable plug 120. Dissolvable plug 120 may be used to protect the entrance to data acquisition port 101 such as from debris and cement during a cement process. Dissolvable plug 120 typically comprises a material, e.g. magnesium or another metal, that will dissolve within a predetermined time, e.g. a few hours to a few days, and, once dissolved, provide a clean path from the formation pressure to elements within downhole module 1 such as a pressure gauge. By way of example and not limitation, dissolvable plug 120 can be secured into data acquisition port 101 and after cementing dissolvable plug 120 can dissolve, opening up pathway between data acquisition port 101 and a reservoir.

In certain embodiments, including without limitation those with dissolvable plug 120, probe 110 may be present and deployed, e.g. inserted, into an associated data acquisition sensor port 101. Probe 110, which may part of data acquisition sensor 8, is typically configured to extend a predetermined distance from the protective downhole module housing 5 such as to allow probe 110 to be disposed proximate to or project directly into an external environment relative to downhole module 1. As used herein the external environment may be into the wellbore, such as into a cement layer disposed about an external portion of downhole module 1, a reservoir, or the like, or a combination thereof. Probe 110 may be initially disposed partially or fully within associated data acquisition sensor port 101 and probe actuator 111, which is configured to selectively extend the probe from an initial position to the predetermined distance, used to project probe 110 into the external environment when so desired. Once deployed, probe 110 can stay where it is and does not have to have ports because it can be ported directly to area whose pressure or other characteristics are to be measured. In these embodiments, data acquisition sensor 8 may be part of or otherwise in communication with probe 110.

In these embodiments, downhole module 1 may collect data not only from the inside of the tubing and/or casing of the well (e.g., tubing if it is for production monitoring and casing if it is for frac monitoring) but also from the outside of the casing. The data may be obtained using the system described herein above by deploying downhole module 1 into a wellbore to a predetermined location within the wellbore; providing access to an environment external to downhole module 1 via data acquisition sensor port 101; supplying power to downhole module 1 via its power source 7; using data acquisition sensor 8 to collect data regarding a predetermined characteristic of the environment external to downhole module 1; communicating the data collected downhole by data acquisition sensor 8 to downhole electronics 9; storing the data in the data storage medium; deploying receiver module 1 in the wellbore when and as desired; and using downhole module transceiver to wirelessly transmit data to and receive data from receiver module 2.

The predetermined characteristic of the environment external to downhole module 1 may comprise pressure, temperature, a fluid characteristic such as viscosity or salinity, movement of the downhole module relative to the wellbore, or the like, or a combination thereof. The environment external to downhole module 1 may comprise a location within or beyond a cement layer which surrounds downhole module 1 into a geological formation into which the wellbore extends and, accordingly, the predetermined characteristic of the environment external to downhole module 1 may comprise pressure, temperature, a fluid characteristic, movement of the downhole module relative to the wellbore, or the like, or a combination thereof, where the predetermined characteristic is obtained directly from the geological formation.

Where downhole module 1 further comprises probe 110, downhole module 1 may be deployed into the wellbore to a predetermined location within the wellbore by selectively extending probe 110 into the environment external to downhole module 1 when downhole module 1 is at the predetermined location such as before a cement operation.

Where downhole module 1 further comprises dissolvable plug 120 inserted into a predetermined portion of acquisition sensor ports 101, downhole module 1 may be deployed into the wellbore and dissolvable plug 120 exposed to a fluid which will dissolve dissolvable plug 120 once downhole module 1 has reached the predetermined location within the wellbore. The fluid may be a fluid containing water which will dissolve dissolvable plug 120 or a drilling fluid containing a reactant which will dissolve dissolvable plug 120 or the like.

What is claimed is:

1. A system for data acquisition and short distance wireless data transfer between wellbore modules comprising:

a. a downhole module, comprising:

i. a protective downhole module housing sized to be deployable and secured at a predetermined position within a wellbore;

ii. a downhole module power source disposed within the downhole module housing;

iii. a data acquisition sensor operatively connected to the downhole module power source;

iv. downhole electronics operatively connected to the downhole module power source, disposed within the downhole module housing, and operatively in communication with the data acquisition sensor, the downhole electronics further comprising:

1. a transceiver; and

2. a data storage medium;

v. a short distance wireless data communication antenna operatively in communication with the transceiver;

vi. a standoff disposed about an outer portion of the downhole module housing and configured to extend from the outer portion of the downhole module to a distance proximate the wellbore into which the downhole module is disposed; and vii. a data acquisition sensor port extending through the standoff and operatively in communication with the data acquisition data acquisition sensor; and b. a separate receiver module comprising:

i. a protective receiver housing sized to be removably deployable within the wellbore;

ii. a receiver power source disposed within the receiver housing;

iii. receiver electronics operatively connected to the receiver power source and at least partially disposed within the receiver housing, the receiver electronics further comprising:

1. a receiver transceiver configured to cooperatively communicate with the downhole module transceiver; and 2. a receiver data storage medium operatively in communication with the receiver electronics; and iv. a wireless data communications receiver antenna operatively in communication with the receiver transceiver.

2. The system of claim 1, wherein the standoff comprises:

a. a selectively movable standoff; and b. a selectively engageable standoff mover operatively connected to the selectively movable standoff.

3. The system of claim 2, wherein the selectively engageable standoff mover comprises a piston, a spring, or a hydraulic actuator.

4. The system of claim 1, wherein the standoff extends to a distance which places the standoff into contact with the wellbore into which the downhole module is disposed.

5. The system of claim 1, wherein:

a. the data acquisition sensor is adapted to measure a predetermined borehole or production parameter regarding a reservoir into which the wellbore extends; and b. the standoff extends to a distance which allows the data acquisition sensor to obtain a measurement of the predetermined borehole or production parameter regarding the reservoir into which the wellbore extends.

6. The system of claim 1, wherein the data acquisition sensor further comprises a pressure data acquisition sensor, a fluid identification data acquisition sensor, a fluid characteristic data acquisition sensor, a fluid flow data acquisition sensor, or a temperature data acquisition sensor.

7. The system of claim 1, further comprising a dissolvable plug inserted into a predetermined portion of the data acquisition sensor port.

8. The system of claim 7, wherein:

a. the data acquisition sensor port comprises an internal thread; and b. the dissolvable plug comprises an external thread complimentary to the data acquisition sensor port internal thread.

9. The system of claim 1, further comprising a probe inserted into the data acquisition sensor port and configured to extend a predetermined distance from the protective downhole module housing.

10. The system of claim 9, wherein the predetermined distance is sufficient to allow the probe to intrude into the wellbore or a reservoir.

11. The system of claim 9, further comprising a probe actuator configured to selectively extend the probe from an initial position to the predetermined distance.

12. The system of claim 9, wherein the data acquisition sensor comprises the probe.

13. The system of claim 1, wherein the standoff comprises a set of standoffs arranged circumferentially about an outer portion of the protective downhole module housing.

14. The system of claim 1, wherein the standoff extends or retracts radially with respect to the protective downhole module housing.

15. A method of gathering data from a wellbore using a system for data acquisition and short distance wireless data transfer between wellbore modules comprising, a downhole module comprising a protective downhole module housing sized to be deployable and secured at a predetermined location within the wellbore, a downhole module power source disposed within the downhole module housing, a data acquisition sensor disposed at least partially within the downhole module housing and operatively connected to the downhole module power source, downhole electronics operatively connected to the downhole module power source and disposed within the downhole module housing where the downhole electronics are operatively in communication with the data acquisition sensor and the downhole electronics further comprise a transceiver and a data storage medium, a short distance wireless data communication antenna operatively in communication with the transceiver, a standoff disposed about an outer portion of the downhole module housing and configured to extend from the outer portion of the downhole module to a distance proximate the wellbore into which the downhole module is disposed, and a data acquisition sensor port extending through the standoff and operatively in communication with the data acquisition sensor; and a separate receiver module comprising a protective receiver housing sized to be removably deployable within the wellbore, a receiver power source disposed within the receiver housing, receiver electronics operatively connected to the receiver power source and at least partially disposed within the receiver housing where the receiver electronics further comprises a receiver transceiver configured to cooperatively communicate with the downhole module transceiver and a receiver data storage medium operatively in communication with the receiver electronics, and a wireless data communications receiver antenna operatively in communication with the receiver transceiver, the method comprising:

a. deploying the downhole module into the wellbore to the predetermined location within the wellbore;
b. providing access to an environment external to the downhole module via the data acquisition sensor port extending through the standoff;
c. supplying power to the downhole module via its power source;
d. using the data acquisition sensor to collect data regarding a predetermined characteristic of the environment external to the downhole module;
e. communicating the data collected downhole by the data acquisition sensor to the downhole electronics;
f. storing the data in the data storage medium;
g. deploying the receiver module in the wellbore; and
h. using the downhole module transceiver to wirelessly transmit data to and receive data from the receiver module.

16. The method of claim 15, wherein the predetermined characteristic of the environment external to the downhole module comprises pressure, temperature, a fluid characteristic, or movement of the downhole module relative to the wellbore.

17. The method of claim 15, wherein:

a. the environment external to the downhole module comprises a location into a geological formation into which the wellbore extends; and
b. the predetermined characteristic of the environment external to the downhole module comprises pressure, temperature, a fluid characteristic, or movement of the downhole module relative to the wellbore obtained directly from the geological formation.

18. The method of claim 15, wherein:

a. the downhole module further comprises a probe disposed within a predetermined portion of the data acquisition sensor port; and
b. deploying the downhole module into the wellbore to the predetermined location within the wellbore further comprises selectively extending the probe into the environment external to the downhole module.

19. The method of claim 15, wherein:

a. the downhole module further comprises a dissolvable plug inserted into a predetermined portion of the data acquisition sensor port; and
b. deploying the downhole module into the wellbore to the predetermined location within the wellbore further comprises exposing the dissolvable plug to a fluid which will dissolve the dissolvable plug once the downhole module has reached the predetermined location within the wellbore.

* * * * *